US012324549B2

(12) United States Patent
Schmidt

(10) Patent No.: US 12,324,549 B2
(45) **Date of Patent: *Jun. 10, 2025**

(54) WALL-MOUNTED METERING DISPENSER

(71) Applicant: ADA Cosmetics International GmbH, Kehl/Baden (DE)

(72) Inventor: Johannes Schmidt, Kehl/Baden (DE)

(73) Assignee: ADA Cosmetics International GmbH, Kehl/Baden (DE)

( * ) Notice: Subject to any disclaimer, the term of this patent is extended or adjusted under 35 U.S.C. 154(b) by 0 days.

This patent is subject to a terminal disclaimer.

(21) Appl. No.: 18/610,501

(22) Filed: Mar. 20, 2024

(65) Prior Publication Data

US 2024/0215770 A1 Jul. 4, 2024

Related U.S. Application Data

(63) Continuation of application No. 17/966,987, filed on Oct. 17, 2022, now Pat. No. 11,963,645.

(30) Foreign Application Priority Data

Oct. 15, 2021 (DE) ..... 102021126805.2

(51) Int. Cl.
*A47K 5/12* (2006.01)

(52) U.S. Cl.
CPC ..... *A47K 5/1202* (2013.01); *A47K 5/1209* (2013.01); *A47K 2201/02* (2013.01)

(58) Field of Classification Search
CPC ..... A47K 5/1202; A47K 2201/02; A47K 5/1205; B05B 11/1047; B05B 11/1049; B05B 15/62; B65D 35/565
See application file for complete search history.

(56) References Cited

U.S. PATENT DOCUMENTS 4,582,227 A * 4/1986 Kanfer ..... A47K 5/1205 248/312.1
4,615,476 A * 10/1986 Hobbs ..... A47K 5/1211 222/153.09

(Continued)

FOREIGN PATENT DOCUMENTS

AU 2020100865 A4 7/2020
CN 2099099 U 3/1992

(Continued)

*Primary Examiner* — Bob Zadeh
(74) *Attorney, Agent, or Firm* — Volpe Koenig

(57) ABSTRACT

A wall-mounted metering dispenser for a liquid, having a replaceable container and a wall bracket, and having a removal apparatus for removing liquid from the container in a metered manner. The wall bracket has a first fixing location having a fixed retention element for the base region of the container, and a second fixing location having a sleeve which can is separable from or movable relative to the wall bracket which retains the upper region of the container. The removal apparatus is arranged on or integrated in the sleeve and includes a metering pump having a pump chamber that is insertable in the container opening and a pump valve and an actuation element that is movable relative to the container and cooperates with the pump valve and has a liquid discharge opening connected to the pump chamber via a discharge channel. The actuation element is guided in the sleeve.

8 Claims, 7 Drawing Sheets

(56) References Cited

U.S. PATENT DOCUMENTS

| | | | | |
|---|---|---|---|---|
| 8,893,929 | B2 * | 11/2014 | Geiberger | A47K 5/122 222/181.3 |
| 9,010,581 | B2 | 4/2015 | Presche | |
| 11,963,645 | B2 * | 4/2024 | Schmidt | B65D 35/565 |
| 2011/0259920 | A1 | 10/2011 | Rennie et al. | |
| 2012/0199609 | A1 | 8/2012 | Schwenkenberg | |
| 2013/0092708 | A1 | 4/2013 | Geiberger | |
| 2013/0200107 | A1 | 8/2013 | Presche | |
| 2022/0097911 | A1 | 3/2022 | Lowance et al. | |
| 2023/0121064 | A1 | 4/2023 | Schmidt | |
| 2024/0215770 | A1 * | 7/2024 | Schmidt | A47K 5/1205 |

FOREIGN PATENT DOCUMENTS

| | | | | |
|---|---|---|---|---|
| CN | 102190116 | B | 10/2014 | |
| CN | 102941967 | B | 4/2016 | |
| CN | 102946779 | B | 5/2016 | |
| CN | 208915807 | U | 5/2019 | |
| CN | 111936019 | | 11/2020 | |
| CN | 212118000 | U | 12/2020 | |
| DE | 3833663 | A1 * | 4/1990 | |
| DE | 29601918 | | 6/1997 | |
| DE | 4401958 | | 8/1997 | |
| DE | 102009024769 | | 12/2010 | |
| DE | 102010024081 | | 5/2014 | |
| DE | 202018104265 | U1 | 10/2018 | |
| DE | 202020004880 | U1 | 1/2021 | |
| DE | 102021126809 | A1 * | 9/2022 | |
| DE | 102014007298 | B4 | 6/2023 | |
| EP | 2127580 | A2 * | 12/2009 | A47K 5/12 |
| JP | 2011184086 | | 9/2011 | |
| PT | 2063746 | | 2/2010 | |
| WO | 2005006931 | A1 | 1/2005 | |
| WO | 2008028608 | | 3/2008 | |
| WO | 2019063173 | A1 | 4/2019 | |
| WO | 2021037862 | A1 | 3/2021 | |
| WO | WO-2021177878 | A1 * | 9/2021 | A47K 5/12 |

* cited by examiner

WALL-MOUNTED METERING DISPENSER

CROSS-REFERENCE TO RELATED APPLICATIONS

This application is a continuation of U.S. patent application Ser. No. 17/966,987, filed Oct. 17, 2022, which claims priority from German Patent Application No. DE 10 2021 126 805.2, filed Oct. 15, 2021, both of which are incorporated herein by reference as if fully set forth.

TECHNICAL FIELD

The invention relates to a wall-mounted metering dispenser for providing and removing a liquid, in particular a washing-active substance or a care product for body care.

BACKGROUND

Such a wall-mounted metering dispenser accordingly comprises a replaceable container for the fluid which may have both a low viscosity and a very high viscosity, and a wall bracket for fitting the wall-mounted metering dispenser to a structural arrangement, generally a wall.

The structural arrangement, to which the wall-mounted metering dispenser is fitted, is preferably a building wall, for example, in the bathroom of a hotel or in public sanitary facilities; however, it may also be a furniture component or a special retention member or a frame.

The container for the liquid can be fixed to the wall bracket and removed from it in order to either fill or replace it. It has a base region having a container base and, in a state opposite it, an upper region having a removal opening, wherein the wall bracket has two mutually spaced-apart fixing locations for the container, of which a first fixing location is provided with a fixed retention element for the base region of the container, in which retention element the container can be inserted or on which retention element the container base can be placed in order to retain the base region of the container in a positive-locking and/or non-positive-locking manner at the first fixing location, and of which a second fixing location has a sleeve which can be separated from the wall bracket or which is movable relative thereto and which can be fixed to the wall bracket in order to retain and where applicable insert the upper region of the container.

In any case when the container is located in the wall bracket, a removal apparatus is located at the removal opening in the upper region of the container in order to remove liquid from the container in a metered manner. This removal apparatus is arranged on the sleeve in order to retain the upper region of the container or is at least partially integrated therein.

Wall-mounted metering dispensers having a replaceable container for storing and providing a liquid and having a removal apparatus for removing liquid from the container are used, for example, in publicly accessible toilet areas or corresponding rooms of restaurants in order to provide liquid soap. In a particularly preferable manner, however, such metering dispensers are used in hotels in order to provide liquid soap, hair shampoo and other care products, such as lotions or the like, at wash basins, in the region of a bath tub or in a shower cubicle. This is because wall-mounted metering dispensers of the present type are characterized in that the liquid products stored therein can be removed in a metered and completely hygienic manner while nevertheless a specific volume of the liquid products can be stored in order to extend the duration of use until the dispenser is refilled or until the necessary replacement of the container to longer time periods of typically several days.

Wall-mounted metering dispensers of the present type are generally constructed in such a manner that the container is inserted upside-down in the wall bracket, that is to say, with a downwardly directed removal opening. The removal of the liquid is therefore carried out partially using gravitational force; a user holds his/her hand under the removal apparatus, from which the liquid falls downward. This means that the removal apparatus has to be provided with a valve which directly or indirectly closes the upper region of the container and which is opened by the user only in order to remove the liquid.

The valve can be opened by means of an actuation mechanism, for example, via an actuation lever. Since, in a wall-mounted metering dispenser of the present type, however, usually liquids with a relatively high viscosity are provided, gravitational force is often not sufficient to discharge the liquid within an acceptable time when a removal valve is opened. Therefore, it is known to provide the removal apparatus with a removal valve which opens in the case of a pressure being applied to the container, wherein the container is configured to this end at least in regions in a flexible manner. In this instance, there is provision for the user, as described, for example, in DE 296 01 918 U1, to apply pressure to the container indirectly or to act directly on the container, as known, for example, from DE 10 2009 024 769 B2 or DE 10 2010 024 081 A1.

However, the need to apply pressure to the container of the metering dispenser in order to discharge a desired quantity of the liquid stored therein is not optimum in all situations. This is because the user must in any case apply a specific force in order to be able to remove liquid. This sometimes makes precise metering more difficult so that often more liquid is removed than intended.

The operation of such a known wall-mounted metering dispenser is also not perceived to be intuitive in every cultural circle. This is because both hands have to be put into action at the same time at different locations with different functions, that is to say, one hand of the user has to be held under the removal apparatus in order to catch discharged liquid while the other hand of the user, at a different location, that is to say, at the container, is responsible for discharging the liquid and actuating the valve by pressing it together. Consequently, it is repeatedly the case that discharged liquid is not caught, in this regard it is lost and causes increased cleaning complexity.

In principle, it is also difficult for many users to anticipate the location at which the liquid is discharged in the event of pressure on the container when the removal apparatus is arranged under the container and the liquid is discharged directly downwardly. This is because the user generally does not see the wall-mounted metering dispenser from below so that the discharge opening is hidden for him/her when using the wall-mounted metering dispenser.

SUMMARY

Taking this prior art as a basis, an object of the present invention is to modify a wall-mounted metering dispenser of the type mentioned in the introduction in such a manner that the removal apparatus is provided with a discharge opening which is visible to the user and the user can carry out an action in the region of the discharge opening in order to discharge the liquid.

This object is achieved by a wall-mounted metering dispenser having one or more of the features disclosed herein. Preferred embodiments of the wall-mounted metering dispenser according to the invention are described below and in the claims.

In order to achieve the object, the invention uses a configuration of a wall-mounted metering dispenser which largely corresponds to the teaching of DE 10 2010 024 081 B1. Consequently, this involves a wall-mounted metering dispenser for providing and removing a liquid having a replaceable container for the liquid and having a wall bracket for fitting the wall-mounted metering dispenser to a structural arrangement, and having a removal apparatus for removing liquid from the container in a metered manner, wherein the container has a base region having a container base and, in a state opposite it, an upper region having a removal opening, wherein the wall bracket has two mutually spaced-apart fixing locations for the container, of which a first fixing location is provided with a fixed retention element for the base region of the container, in which retention element the container can be inserted or on which retention element the container base can be placed in order to retain the base region of the container in a positive-locking and/or non-positive-locking manner at the first fixing location, and of which a second fixing location has a sleeve which can be separated from the wall bracket or which is movable relative thereto and which can be fixed to the wall bracket in order to retain the upper region of the container, and wherein the removal apparatus is arranged on the sleeve or is at least partially integrated therein.

This construction type of a wall-mounted metering dispenser allows the container to be inserted between or in the fixing locations of the wall bracket and the sleeve of the second fixing location to be subsequently fixed to the wall bracket and to be provided with a specific securing member which can be opened only with a corresponding release tool or a wrench in order to prevent, on the one hand, theft, and, on the other hand, to prevent at the container manipulations which are intended to be prevented for hygiene reasons. Only trained and authorized operators can release the sleeve from the fixing arrangement and separate it from the wall bracket or move it relative thereto so that the container can also be released at the base region thereof from the fixed retention element at that location and finally can be removed or replaced.

According to the invention, in order to achieve the object set, this construction type of the wall-mounted metering dispenser is modified in that the removal apparatus is in the form of a metering pump which comprises a pump body which can be inserted in the removal opening of the container and which has a pump chamber and pump valve and an actuation element which can be moved relative to the container and which is constructed for mechanical cooperation with the pump valve and which has a discharge opening for the liquid which is connected to the pump chamber via a discharge channel, wherein the actuation element is guided in the sleeve.

The metering pump according to the invention consequently has an actuation element which can be moved relative to the container and which at the same time also contains the discharge opening for the liquid so that an intuitive operation of the wall-mounted metering dispenser is ensured. The component of the wall-mounted metering dispenser in which the discharge opening for the liquid is located must be gripped and pressed by the user in order to bring about the discharge of liquid.

The fact that the actuation element of the metering pump is guided according to the invention in the sleeve of the wall-mounted metering dispenser increases the stability of the wall-mounted metering dispenser because the container remains free from actuation forces which deviate from the vertical axis of the container and which would consequently not be taken up by the fixed retention element at the first fixing location of the wall bracket. The sleeve also allows precise guiding of the actuation element of the metering pump. When the container is replaced, the actuation element does not also have to be replaced, which is ultimately very advantageous from points of view of sustainability.

The wall-mounted metering dispenser according to the invention can be mounted as in the prior art so that the container is orientated upside-down, that is to say, the base region thereof is arranged at the top, while the removal apparatus is located at the bottom. However, the metering pump according to the invention allows the liquid also to be removed from the container without the assistance of gravitational force so that it is preferable not to fit the wall-mounted metering dispenser according to the invention to the structural arrangement as in the prior art but instead in a transposed manner. The base region of the container is consequently at the bottom and the upper region of the container with the removal apparatus is arranged at the top. This affords the great advantage that a user looks directly at the actuation element of the removal apparatus or the metering pump and can actuate the metering pump by pressing in a downward direction.

In the context of the present invention, the retention element for the base region of the container can be a hook-like shaped component which engages in a correspondingly shaped recess in the base region of the container. This provides a secure positive-locking retention of the container with respect to the wall bracket and also protects the container from being rotated about the vertical axis thereof. Alternatively, the retention element for the base region of the container can also be in the form of a plate-like or pan-like shaped component or in the form of a basket in order to receive the base region of the container and to secure it in a positive-locking and/or non-positive-locking manner so as to prevent lateral sliding. A basket-like or plate-like or pan-like retention element can perform this securing function, advantageously by means of a flanged edge or with projections which project peripherally and which are bent over or crown-like indentations.

The second fixing location with respect to the wall bracket preferably has a snap-fitting snap-fit connection for fixing the sleeve to the wall bracket which can be released only by means of a corresponding release tool or wrench. As already mentioned, not only can theft thereby be prevented, but also it can be ensured that the content of the container is completely hygienic at all times because it cannot be opened by the user or by other unauthorized persons.

The removal opening of the container of the wall-mounted metering dispenser according to the invention is preferably in the form of a bottleneck having an outer thread. The sleeve at the second fixing location which can be fixed to the wall bracket and which can be moved in order to replace the container relative to the wall bracket preferably has an inner thread which fits on this outer thread of the container. Therefore, the container can be unscrewed from the sleeve for replacement or a refilling operation and screwed back into the sleeve again, which also ensures a reliable positive-locking connection and fixing of the container to the wall bracket in this case.

Particularly when the retention element for the base region of the container at the first fixing location is not a hook-like shaped component which prevents the container from being rotated about the vertical axis thereof, it is particularly advantageous if the sleeve is provided with a reverse rotation prevention member. Once the container is screwed into the sleeve, it cannot then be separated from the sleeve any more without releasing the reverse rotation prevention member.

For hygiene reasons, it is often preferable for the container not to be able to be separated from the sleeve any more as soon as the wall-mounted metering dispenser has been put into use. In this case, in the context of the present invention it is preferable for the reverse rotation prevention member to comprise a number of teeth which are arranged in such a manner that they contact the bottleneck of the container and/or the outer thread thereof during screwing into the inner thread of the sleeve, wherein they are configured to be shaped and/or to be resiliently deformable in such a manner that they make it at most slightly more difficult to screw the outer thread into the inner thread, but conversely cause the outer thread not to be able to be unscrewed from the inner thread again without being destroyed.

This can preferably be implemented so that the sleeve is produced from a plastics material and the teeth of the reverse rotation prevention member are configured from resiliently bendable tongues which are formed on the sleeve and which approximately tangentially abut the bottleneck or the outer thread thereof.

A reverse rotation prevention member which is configured in such a manner can further be supported in that the bottleneck is provided in the manner of a locking wheel with a ring comprising tooth arrangements each having a flat flank and a steep flank so that the teeth of the reverse rotation prevention member act as detent pawls.

In the context of the present invention, the discharge opening for the liquid is preferably located at the tip of a discharge spout on the actuation element, wherein the sleeve of the wall-mounted metering dispenser has for the discharge spout a recess, in which the discharge spout is introduced in the case of a pump stroke. As long as the discharge spout is not aligned with the recess, but instead is rotated opposite it about the vertical axis of the container, no pump stroke can be carried out and no liquid can be dispensed. This may involve advantages for transporting a refill container.

Finally, the container of the wall-mounted metering dispenser according to the invention may be provided with at least one transparent or translucent stripe, which extends from the upper region as far as the base region, in order to read the filling level.

BRIEF DESCRIPTION OF THE DRAWINGS

Two embodiments of a wall-mounted metering dispenser which is configured according to the invention are described and explained in greater detail below with reference to the appended drawings, wherein inventively significant features may also be contained in the description of the Figures but the invention is not limited by the specific features which are described by way of example. In the drawings.

DETAILED DESCRIPTION

Figure 1:
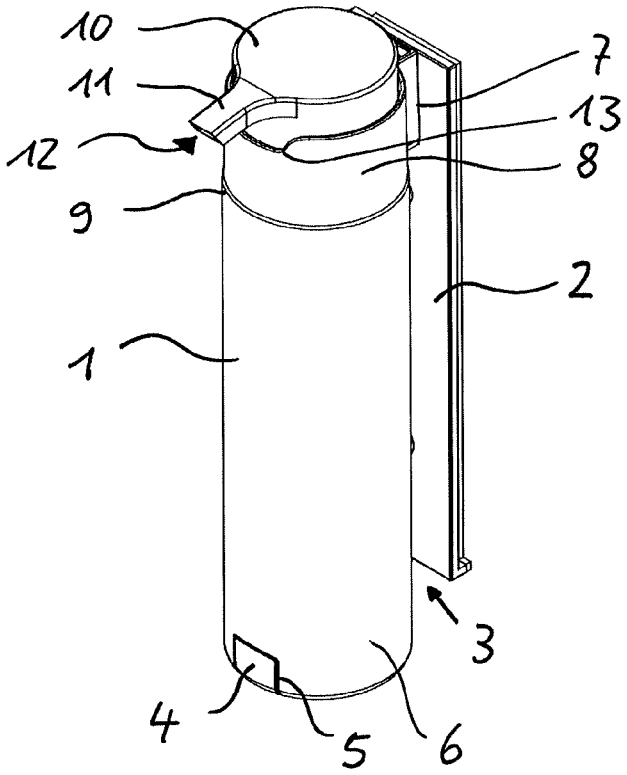
FIG. 1 shows an isometric view of an embodiment of a wall-mounted metering dispenser according to the invention.

FIG. 1 generally shows an isometric view of the embodiment described here of a wall-mounted metering dispenser configured according to the invention. A container 1 for a care product is retained by a wall bracket 2 which is itself fixed to a wall (not illustrated). The wall bracket 2 retains the container 1 at a first fixing location 3 with a fixed retention element which is in the form of a hook-like shaped component 4 in this case. This shaped component engages in a recess 5 in a base region 6 of the container 1 in a positive-locking manner so that the container 1 is protected against sliding laterally off the first fixing location 3 and also against rotation about the vertical axis thereof.

There is located at a second fixing location 7 of the wall bracket 2 a sleeve 8 which is placed on an upper region 9 (hidden here) of the container 1 and which thereby retains the container 1 also in a positive-locking manner on the wall bracket 2. The sleeve 8 can be released by means of a release tool (not illustrated) from the wall bracket 2 in order to pull the container 1 with the sleeve 8 upward out of the wall bracket 2 and to lift it in this case out of the engagement with the hook-like shaped component 4. In this manner, the container 1 can be replaced very easily.

In another embodiment (not illustrated), the retention element can have a different shape at the first fixing location 3 of the wall bracket 2, in particular a plate-like or pan-like shape, so that the container 1 can be placed in this retention element at the first fixing location 3. Alternatively, the retention element may also be basket-like or may be in any other form with which it can secure the base region 6 of the container 1 connected to the sleeve 8 securely to the wall bracket 2.

In another embodiment (not illustrated), the sleeve 8 can also be simply released at the second fixing location 7 and moved relative to the wall bracket 2 so that it is possible to remove the container 1 from the sleeve 8 in order also to release it from the first fixing location 3 and to remove it from the wall bracket 2.

As FIG. 1 finally also shows, an actuation element 10 of a metering pump is arranged at an upper region 9 of the container 1, inside the sleeve 8 and in a state guided thereby, in order to convey liquid out of the interior thereof in a metered manner through a removal opening (not visible here) in the upper region 9 of the container 1 into a discharge channel 11 which is in this case in the form of a discharge spout and to discharge the liquid finally out of a discharge opening 12.

The sleeve 8 has at an upper, circumferential edge a recess 13, in which the discharge spout or the spout-like discharge channel 11 can be introduced in the case of a pump stroke of the actuation element 10; this is because the actuation element 10 is pressed downward toward the container 1 in order to actuate the metering pump. In this case, the liquid or the care product is discharged through the discharge opening 12.

Figure 2:
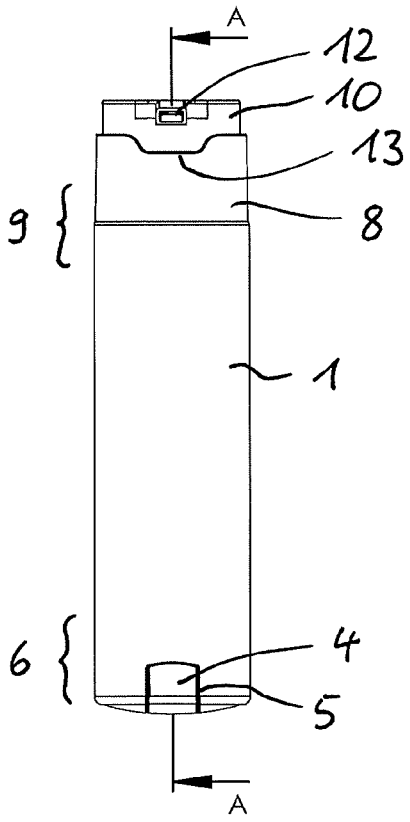
FIG. 2 shows a front view of the wall-mounted metering dispenser from FIG. 1.

FIG. 2 is a front view of the wall-mounted metering dispenser from FIG. 1, wherein identical reference numerals have been used for the features thereof and in this regard reference may be made to the description of FIG. 1.

Figure 3:
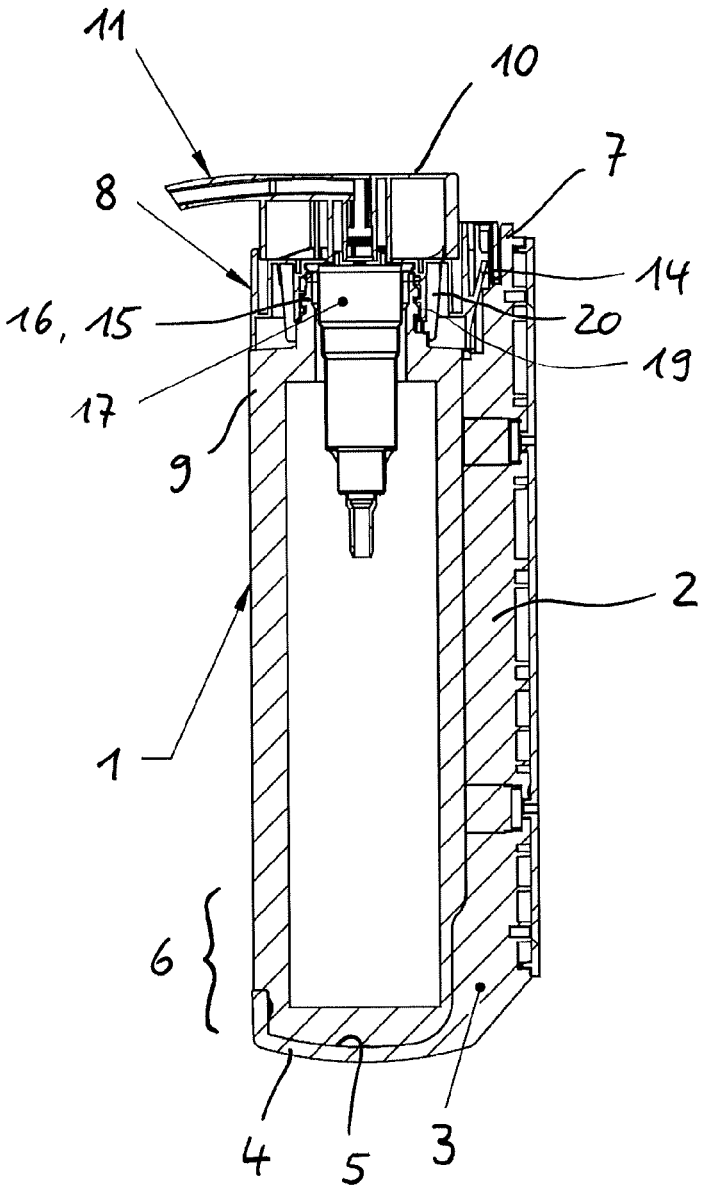
FIG. 3 shows a sectioned view in the plane A-A from FIG. 2.

FIG. 3, a sectioned illustration in the plane A-A from FIG. 2, illustrates additional details of the embodiment. The container 1 with the base region 6 and the upper region 9 thereof, the wall bracket 2 with the first fixing location 3 and the second fixing location 7, the hook-like shaped component 4 which engages in the recess 5 of the container 1 and the sleeve 8 with the actuation element 10 guided therein have already been explained in greater detail with reference to FIGS. 1 and 2.

As a result of the sectioned illustration, FIG. 3 shows at the second fixing location 7 a snap-fitting snap-fit connection 14, with which the sleeve 8 is secured to the wall bracket 2 and which can be released only with a release tool (not illustrated) in order to be able to remove the sleeve 8 from the wall bracket 2. The actuation element 10 which is guided inside the sleeve 8 is not an obstacle in this case as a result of the guiding in the sleeve 8 and is conversely not impaired by the release tool.

As also shown by the sectioned illustration in FIG. 3, the sleeve 8 is placed on the upper region 9 of the container 1 so that it is securely retained in a positive-locking and secure manner. As described in even greater detail below with reference to the additional drawings, the connection of the container 1 and sleeve 8 is ultimately a screw connection; this is because a removal opening 15 of the container 1 is formed by a bottleneck at the upper region 9 thereof which is provided with an outer thread 16.

As can readily be seen in FIG. 3, according to the invention a pump body 17 with a pump chamber and pump valve (not visible in this illustration) is located in the removal opening 15 of the container 1 in the form of a bottleneck. This is a pump body of a commercially available metering pump so that a detailed description of the pump chamber and pump valve and the operating method thereof is unnecessary. The pump valve and the pump chamber of the pump body 17 are activated via an actuation surface 18 which cooperates in turn with the actuation element 10. A pressure on the actuation element 10 brings about a pump stroke and consequently a discharge of liquid from the container 1 via the discharge channel 11 which is integrated in the actuation element 10, as known per se.

As will be explained in even greater detail below with reference to the additional drawings, the sleeve 8 has an inner thread 19 with which it is located on the outer thread 16 of the removal opening 15. In this case, a reverse rotation prevention member 20 prevents the container 1 from being able to be released from the sleeve 8 again as soon as the wall-mounted metering dispenser is assembled ready for use.

Another embodiment (not illustrated) dispenses with a reverse rotation prevention member so that all the components which are replaced during replacement of the container can be re-filled and used again. This may be desirable for reasons of sustainability.

Figure 4:
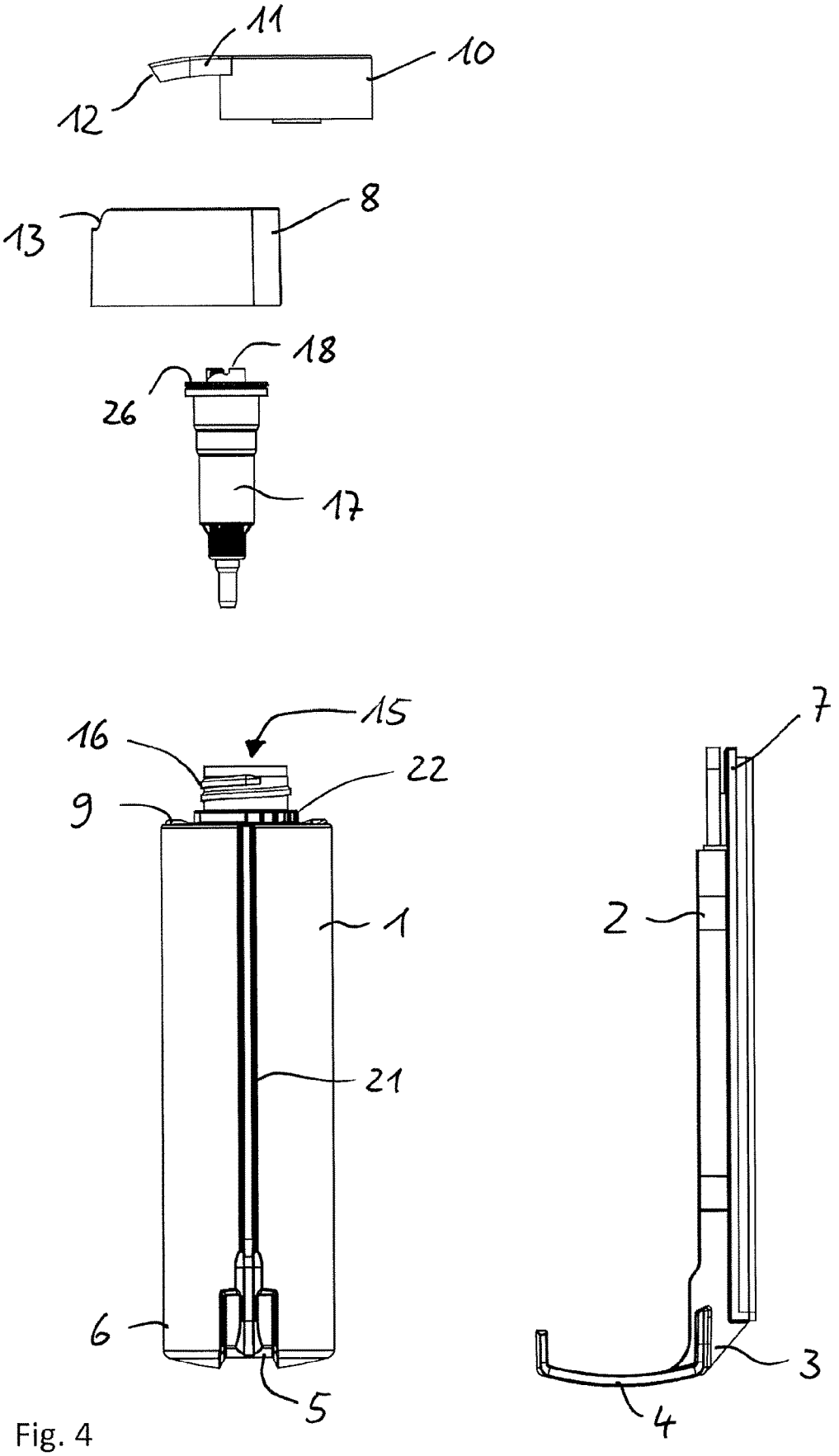
FIG. 4 shows a schematic, exploded illustration of the wall-mounted metering dispenser from FIG. 1.

FIG. 4 shows an exploded illustration of the wall-mounted metering dispenser from FIGS. 1 to 3, wherein in this instance identical components are also indicated again with identical reference numerals. This Figure shows that the present embodiment of a wall-mounted metering dispenser according to the invention substantially comprises a container 1 having the removal opening 15, the outer thread 16, the recess 5 and a stabilizing groove 21, a wall bracket 2 having a first fixing location 3 and a second fixing location 7 and the hook-like shaped component 4 as a retention element for the base region 6 of the container 1, a sleeve 8 having a recess 13, a pump body 17 with an actuation surface 18 and a sealing ring 26 and an actuation element 10 with a discharge channel 11 and discharge opening 12.

Tooth arrangements 22 for the reverse rotation prevention member are located in the upper region 9 of the container 1, as will be explained in greater detail below.

Figure 5:
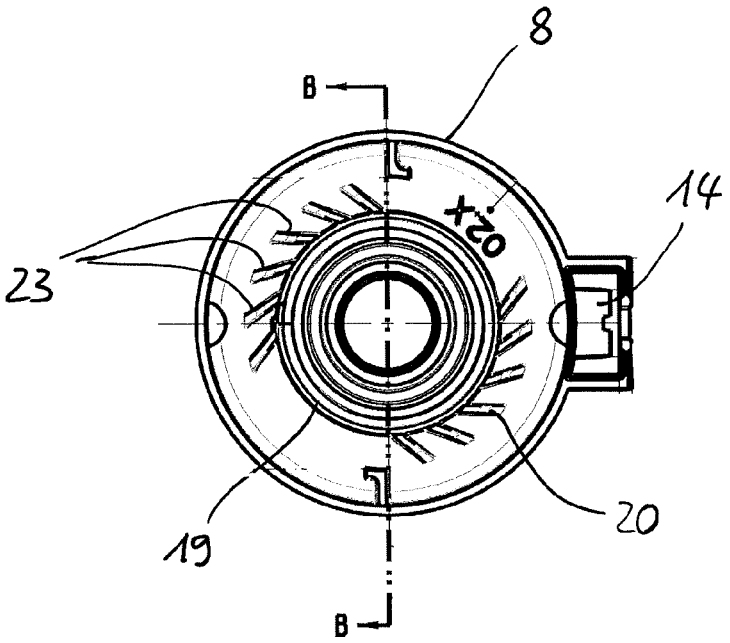
FIG. 5 shows a plan view of the sleeve of the wall-mounted metering dispenser.
Figure 6:
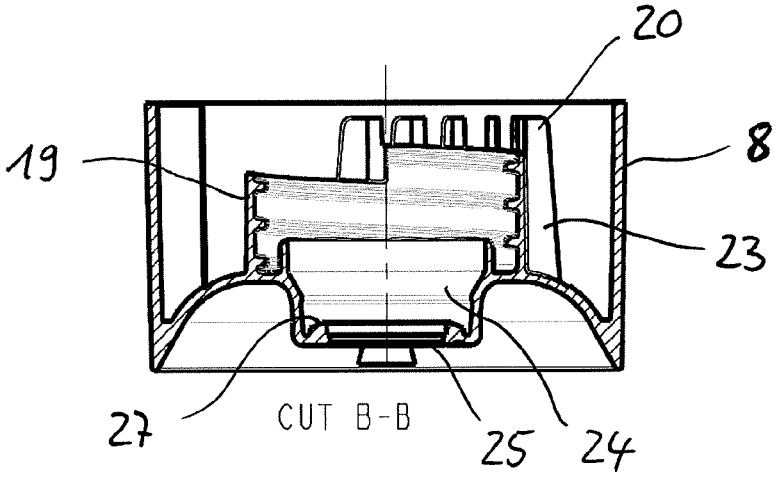
FIG. 6 shows a section in the plane B-B from FIG. 5.
Figure 7:
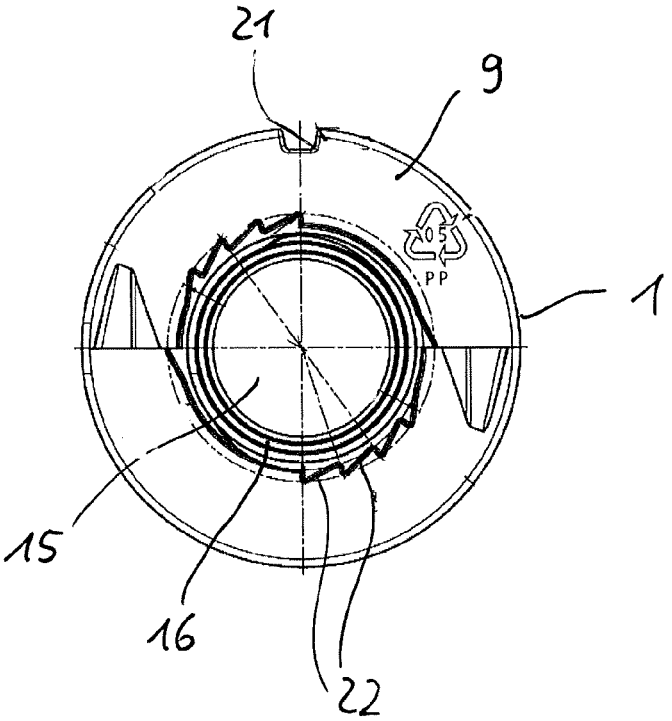
FIG. 7 shows a plan view of the upper region of a container.

FIG. 5 shows a plan view of the sleeve 8 while FIG. 6 shows a sectioned side view of the sleeve 8 in the plane B-B from FIG. 5. These illustrations show that the sleeve 8 is provided with an inner thread 19 for receiving the outer thread 16 of the container 1. There are further provided a number of teeth 23 as a reverse rotation prevention member 20. These teeth 23 are made from polypropylene, as is the entire sleeve 8, and they consequently have a specific inherent resilience. They are formed on the sleeve 8 and are in the form of tongues which approximately tangentially abut the bottleneck of the container 1 so that they scarcely make it any harder to screw in the outer thread 16, but do not allow the outer thread 16 to be unscrewed backward from the inner thread 19 without being destroyed. This last feature is also ensured by the ring of tooth arrangements 22 in the upper region 9 of the container 1, as can be clearly seen in FIG. 4, but also in FIG. 7, a plan view of the container 1. These tooth arrangements 22 are provided with a flat and a steep flank so that the teeth 23 of the reverse rotation prevention member 20 act as detent pawls, wherein the tooth arrangements 22 are arranged on the container 1 in the manner of a locking wheel.

FIG. 5 further illustrates the adaptation of the sleeve 8 to the second fixing location 7 via the snap-fit connections 14.

FIG. 6 further illustrates that the sleeve 8 is provided inside the inner thread 19 thereof with a receiving member 24 for the pump body 17 with a seal 25 for the discharge channel 11. The sealing ring 26 of the pump body 17 (FIG. 4) comes to rest in the sleeve 8 against an abutment face 27 so that an undesirable discharge of liquid at this location is prevented.

Figure 8:
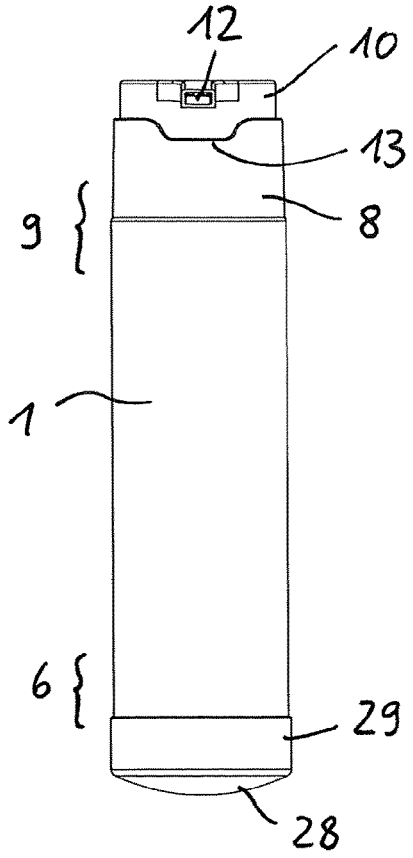
FIG. 8 shows a front view of a second embodiment of a wall-mounted metering dispenser according to the invention.
Figure 9:
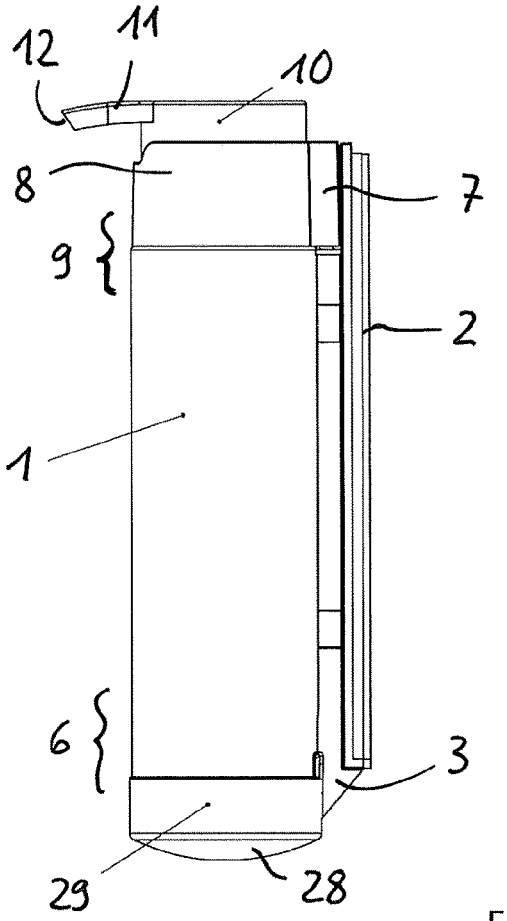
FIG. 9 shows a side view of the wall-mounted metering dispenser from FIG. 8.

FIG. 8 shows a front view, as in FIG. 2, of a second embodiment of a wall-mounted metering dispenser which is configured according to the invention. FIG. 9 shows a side view of this second embodiment. The portions of the second embodiment which is illustrated here and which correspond to the corresponding portions of the first embodiment from FIGS. 1 to 7 are indicated with the same reference numerals. In this regard, reference may be made to the above description of the Figures, in particular FIGS. 1 and 2.

The difference between the second embodiment and the first embodiment involves the configuration of the retention element for the base region 6 of the container 1 at the first fixing location 3. While in the first embodiment according to FIGS. 1 to 7 this retention element is in the form of a hook-like shaped component 4 which engages in a positive-locking manner in a recess 5 in the base region 6 of the container 1, the second embodiment, as FIGS. 8 and 9 particularly show, is provided with a pan-like shaped component 29 as a retention element of the first fixing location 3, wherein the pan-like shaped component 28 is provided with a comparatively high, circumferential edge 29 in order to receive the base region 6 of the container 1 in a positive-locking manner with regard to a movement component which is orientated perpendicularly to the vertical axis of the container 1. The container 1 also cannot thereby be removed from the wall bracket 2 without releasing one of the two fixing locations 3, 7.

Figure 10:
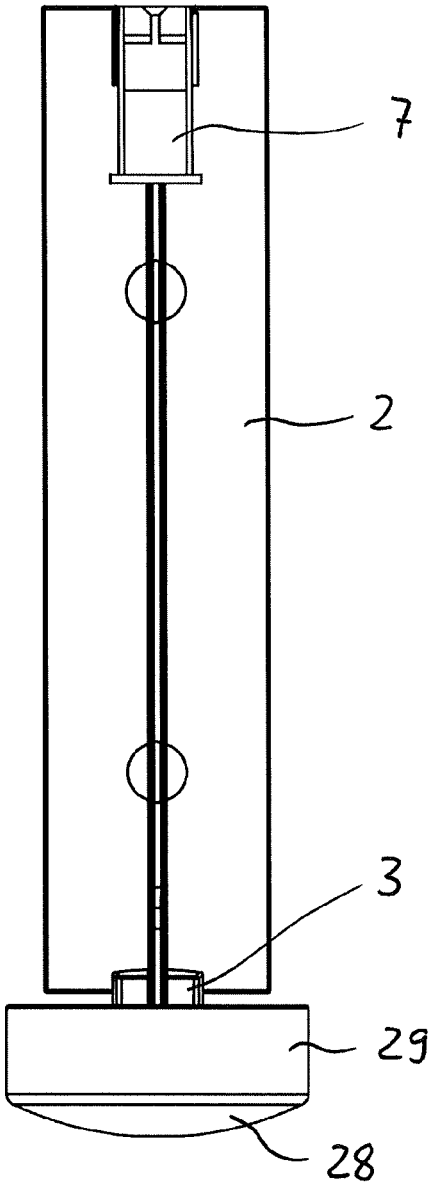
FIG. 10 shows a front view as in FIG. 8, but without any container.

FIG. 10 illustrates the wall bracket 2 of the second embodiment as a front view as in FIG. 8, but without the container 1 in order to set out the differences with respect to the first embodiment even more clearly with the hook-like shaped component 4 thereof. While the second fixing location 7 is configured identically to the first embodiment, the first fixing location 3 carries as a retention element the pan-like shaped component 28 with a circumferential edge 29 for receiving the base region 6 of the container 1. The pan-like shaped component 28 may, for example, be provided centrally with a hole in order to allow the discharge of any liquids, such as condensation water or splashes of water in a shower cubicle, which water has, for example, penetrated between the base region 6 of the container 1 and the circumferential edge 29.

LIST OF REFERENCE NUMERALS

1 Container
2 Wall bracket
3 Fixing location (first)
4 Hook-like shaped component
5 Recess
6 Base region
7 Fixing location (second)
8 Sleeve
9 Upper region
10 Actuation element
11 Discharge channel
12 Discharge opening
13 Recess
14 Snap-fit connection
15 Removal opening
16 Outer thread
17 Pump body
18 Actuation surface
19 Inner thread
20 Reverse rotation prevention member
21 Stabilizing groove
22 Tooth arrangements
23 Teeth
24 Receiving member
25 Seal
26 Sealing ring
27 Abutment face
28 Pan-like shaped component
29 Edge (of 28)

The invention claimed is:

1. A wall-mounted metering dispenser for providing and removing a liquid, the dispenser comprising:

a replaceable container (1) for the liquid;

a wall bracket (2) configured for connecting the wall-mounted metering dispenser to a structural arrangement;

a removal apparatus for removing the liquid from the container (1) in a metered manner;

the container (1) comprises a base region (6) having a container base and, on an opposite side, an upper region (9) having a removal opening (15);

the wall bracket (2) comprises first and second mutually spaced-apart fixing locations (3, 7) for the container (1), the first fixing location (3, 7) including a fixed retention element for the base region (6) of the container (1), the container (1) being insertable in or placeable on the retention element to retain the base region (6) of the container (1) in a positive-locking or non-positive-locking manner at the first fixing location (3), and the second fixing location (7) including a sleeve (8) which is separable from or movable relative to the wall bracket (2) and which is fixable to the wall bracket (2) in order to retain the upper region (9) of the container (1);

the removal apparatus is arranged on the sleeve (8) or is at least partially integrated therein;

the removal apparatus comprises a metering pump which includes a pump body (17) that is insertable in the removal opening (15) of the container (1) and which has a pump chamber and pump valve and an actuation element (10) which is movable relative to the container (1) and is constructed for mechanical cooperation with the pump valve and includes a discharge opening (12) for the liquid, with the discharge opening being connected to the pump chamber via a discharge channel (11), and the actuation element (10) is guided in the sleeve (8); and the removal opening (15) of the container (1) is a bottleneck having an outer thread (16) and the sleeve (8) has an inner thread (19) which fits in said outer thread (16), wherein the outer thread (16) on the bottleneck and the inner thread (19) of the sleeve (8) are arranged to enable at least one of a replacement or refilling operation by unscrewing the container (1) from the sleeve (8) and screwing the container (1) back into the sleeve (8).

2. The wall-mounted metering dispenser as claimed in claim 1, wherein the retention element for the base region (6) of the container (1) comprises a hook-shaped component (4) which engages in a correspondingly shaped recess (13) in the base region of the container (1).

3. The wall-mounted metering dispenser as claimed in claim 1, wherein the retention element for the base region (6) of the container (1) comprises a plate- or pan-shaped component (28) or a basket configured to receive the base region (6) of the container (1) and to secure the base region of the container in a positive-locking or non-positive-locking manner so as to prevent lateral sliding.

4. The wall-mounted metering dispenser as claimed in claim 3, wherein the retention element comprises a flanged, shaped or chamfered edge (29) or projections which project peripherally and which are bent over.

5. The wall-mounted metering dispenser as claimed in claim 1, wherein the second fixing location (7) has a snap-fitting snap-fit connection for fixing the sleeve (8) to the wall bracket (2) which is releasable only by a corresponding release tool or wrench.

6. The wall-mounted metering dispenser as claimed in claim 1, wherein the sleeve (8) comprises a plastics material.

7. The wall-mounted metering dispenser as claimed in claim 1, wherein the discharge opening (12) for the liquid is located at a tip of a discharge spout on the actuation element, and the sleeve (8) has a recess (13) for the discharge spout, in which the discharge spout is introduced during a pump stroke.

8. The wall-mounted metering dispenser as claimed in claim 1, wherein the container (1) includes at least one transparent or translucent stripe, which extends from the upper region (9) as far as the base region (6), to indicate a filling level.

* * * * *